United States Patent [19]

Vollerin et al.

[11] 4,089,630

[45] May 16, 1978

[54] PROCESS FOR MIXING TWO FLUIDS AND APPARATUS FOR CARRYING OUT THIS PROCESS

[75] Inventors: Bernard Vollerin, Geneva; Henri Baumgartner, Bernex, both of Switzerland

[73] Assignee: Pietro Fascione, Milan, Italy

[21] Appl. No.: 679,435

[22] Filed: Apr. 22, 1976

[30] Foreign Application Priority Data

Dec. 11, 1975 Switzerland ..... 16078/75

[51] Int. Cl.[2] ..... F23L 7/00

[52] U.S. Cl. ..... 431/9; 239/407; 239/424.5; 239/426; 431/116

[58] Field of Search ..... 431/9, 115, 116, 176, 431/175; 239/407, 413, 424.5, 425.5, 426, 429, 434, 421, 545

[56] References Cited

U.S. PATENT DOCUMENTS

| | | | |
|---|---|---|---|
| 1,110,991 | 9/1914 | Rusby et al. | 431/115 X |
| 2,717,772 | 9/1955 | Palivos | 239/407 X |
| 3,920,377 | 11/1975 | Yanuki et al. | 431/115 |

FOREIGN PATENT DOCUMENTS

| | | | |
|---|---|---|---|
| 588,815 | 2/1925 | France | 239/545 |

*Primary Examiner*—Edward G. Favors
*Attorney, Agent, or Firm*—Karl F. Ross

[57] ABSTRACT

A process and apparatus for mixing two fluids by generating a pressure drop across a pair of surfaces each forming a wall of a mixing chamber and confronting one another while separating a respective source of fluid from the mixing chamber. The surfaces being provided with mutually aligned and opposing apertures thereby accelerating the respective gases through the apertures in opposing jets. The resulting mixture of the fluids is conducted away from the chamber in a direction substantially parallel to the surfaces.

10 Claims, 2 Drawing Figures

PROCESS FOR MIXING TWO FLUIDS AND APPARATUS FOR CARRYING OUT THIS PROCESS

CROSS REFERENCE TO RELATED APPLICATION

This application is related to the commonly assigned copending application Ser. No. 679,100, filed by Bernard Vollerin concurrently herewith and entitled "METHOD OF AND APPARATUS FOR CONTROLLING COMBUSTION" (now U.S. Pat. No. 4,030,874 issued June 21, 1977).

FIELD OF THE INVENTION

Our present invention relates to a process for mixing two fluids and to an apparatus for carrying out this process and, more particularly, to improvements in the mixing of a recirculated combustion gas and a combustion-sustaining gas such as air for combustion of the mixture with a combustible gas.

BACKGROUND OF THE INVENTION

In the following discussion, reference will be made to combustibles, combustible gas or a combustion-sustaining gas and it may be advantageous to define the terms which will be used herein so as to avoid confusion. In combustion processes, the term "combustible gas" is intended to refer to a gas stream containing combustible matter such as fuel and includes, inter alia, hydrocarbon gases, gases which entrain atomized liquid fuels and gases entraining particulate solid fuels. A combustible is the burnable substance (gas, solid or liquid) itself. The term "combustion-sustaining gas" is used herein to refer to a gas constituting an oxygen carrier and, more generally, will refer to the mixture of air with recirculated combustion gas, the latter being a gas constituting the products of combustion in a combustion chamber.

In the combustion field there are a number of works on the effects of external recirculation of combustion gases and mixing the recirculated gas with air used as the combustion-supporting gas in order to reduce the partial pressure of the oxygen of the combustion-supporting gas.

This reduction of the oxygen partial pressure results in better utilization of the oxygen and permits burning of the fuel (combustible gas) with only a minor excess of air. It is also recognized that, for effective combustion to proceed, it is necessary to bring about a reaction between the oxygen molecules and the combustible molecules. This means that the ratio of the mass flow of oxygen and the mass flow of combustible gas must lie between two limits, that the absolute flow velocity of the oxygen to be mixed with the combustible gas must not exceed a certain value, and that a source of ignition must be provided.

Thus the reduction of the oxygen partial pressure by the recirculation of the combustion gas for a given mass flow of the combustion-sustaining stream, gives an increase in the interaction between molecules of oxygen and combustibles. This dilution of the oxygen, accompanied by good interaction of the components of the combustible mixture, permits reduction in the proportion of excess air (i.e. air in excess of the stoichiometric requirements for complete combustion) and reducing the speed of combustion of the combustible.

Furthermore, the temperature of the flame is reduced and hence the production of nitrogen oxides can be minimized.

While these advantages are recognized, there are, however, few examples of the use of external recirculation in practice. Thus, in a report presented to the 61st Annual Meeting of the Air Pollution Control Association held at St. Paul, Minn. in 1968, relative to the effect of the recirculation of combustion gases on the emissions generated by the combustion of heating oils, the authors conclude that the benefits obtained as to emission of pollutants, with recirculation burning, can very probably be commercially utilized.

However, in their opinion, it will require a significant development program to transform their prototype into a commercial burner and serious problems of functioning would have to be overcome.

In fact, only several large power plants used in the central production of thermoelectric power utilize recirculation burners recyling combustion gas.

In a number of cases significant noise emission, indicative of unstable combustion, have been noted. This phenomenon is explained by the fact that recirculation supplies to the combustion chamber a non-homogeneous mixture of the air-combustion gas at a macroscopic level.

The importance of the problem of mixing in the phenomenon of combustion is basic. Numerous researchers have investigated and continue to investigate this field. See, for example, the works of Pratt, published in the review "Progress in Energy and Combustion Science" (1975, Vol.1).

According to these works, combustion cannot be effective until the mixture of combustion-sustaining and combustible gases has attained a molecular level which, in turn, does not occur in the absence of a macroscopic mixture.

That which is true for the mixture of combustion-sustaining and combustible gases is equally true for the mixture of air with the recirculated combustion gas.

There are also works which are concerned with coherent structures in turbulence systems (see the article by Davies and Yule of Southampton University, published in the Journal of Fluid Mechanics, Vol. 69, part 3, pp 513 – 537). These works have shown that, in a turbulent system, the flow stream comprises a number of entities or "fluid packets" with coherent structures which are able to subsist in spite of movement of the fluid and its passage through machine elements, tubes etc.

When two fluid streams are brought together, e.g. air and combustion gas, therefore, the aforementioned coherent structures are present as fluid packets of different oxygen concentrations such that the macroscopic mixture, which is at least necessary for the systems of a mixture at the molecular level, is not obtained.

It has already been proposed to subdivide a stream of one of the fluids to be mixed into a plurality of jets at the point at which the first fluid is introduced into the stream of the second fluid. This technique increases the surface of contact between the fluids and creates a certain amount of turbulence. However, heterogeneous pockets of fluids can remain in the resulting mixture. As a consequence the oxygen partial pressure is not uniform from one region of the mixing zone to another but varies significantly at different points of the mixture.

When this mixture is introduced into the combustion chamber in the presence of the combustible, it is noted that the speed of combustion varies as a function of the instantaneous oxygen partial pressure (local oxygen partial pressure) and gives rise to unstable combustion. This appears to have been the reason why the recirculation technique has not been widely utilized heretofore in spite of the advantages theoretically demonstrable and experimentally obtainable with this technique.

OBJECTS OF THE INVENTION

It is the principal object of the present invention to provided a process and an apparatus for the overcoming the abovementioned disadvantages by remedying, at least to a significant extent, the lack of homogeneity of a mixture of two fluids.

It is another object of the invention to provide an improved method of mixing two fluids for introduction into a combustion chamber so as to improve the stability of combustion.

It is yet another object of the invention to provide a method of mixing air and recirculated combustion gas so as to form a highly desirable and homogeneous combustion-sustaining gas for introduction into a combustion chamber and combustion therein of a combustible, such as a combustible gas.

It is also an object of the invention to provide an apparatus for the purposes described, i.e. an apparatus capable of homogeneously mixing air and recirculated combustion gas, so as to provide a homogeneous combustion-sustaining gas mixture to be admitted into a combustion chamber.

SUMMARY OF THE INVENTION

These objects are attained, in accordance with the present invention, by creating a pressure drop (negative pressure gradient) between the source of each of the two fluids to be mixed and a zone for collection of the mixture, in order to form two streams which are subdivided each into partial streams or jets of higher velocity than the original streams, at least a major portion of the jets of one of the streams is given a trajectory which is parallel to and coincides with the jets of the other stream in such manner that the jets mutually intersect one another.

More particularly, the invention comprises disposing a plurality of orifices in each of two arrays opposite one another between a source of each gas and a mixing chamber and inducing in the mixing chamber a reduced pressure (a pressure below that of either source) while the orifice surfaces are dimensioned so that the respective fluids pass through the respective orifices in jets trained upon each other at increased velocity before passing collectively as a mixture into the mixing chamber.

The system is preferably the one described in the above-mentioned copending application used for mixing air and recirculated combustion gas from a combustion chamber, e.g. a boiler for a power plant, the gas mixture being thereupon introduced into a burner for combination with a combustible gas or another fuel mixture for ignition within this chamber.

In its apparatus aspects the invention provides a device for intimately and homogeneously mixing two gas streams, preferably air and combustion gases recirculated from a combustion chamber, which comprises means forming a mixing chamber having at least two opposing walls, orifices formed in the walls so as to be opposite one another and respective sources of gas connected to the orifices of each wall so that, when a further means induces a reduced pressure in the mixing chamber, the respective fluids are accelerated through the orifices in opposite directions but in line with one another so that the jets intercept one another and form a homogeneous mixture.

The apparatus may be formed with an evacuation orifice or outlet connected to a suction source such as the intake side of a blower, the orifice surfaces constituting two admission zones disposed one opposite the others and respectively connected to the two sources of fluid. The gas-entrainment means or blower is thus able to create a pressure drop across each orifice surface and thereby accelerated the respective gas streams through the orifices. The sum of the open sections of the orifice surfaces is selected in each case to ensure acceleration of the partial streams of the gases passing through these orifices and hence acceleration and high velocity of the gas jets which emerge from the orifices.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
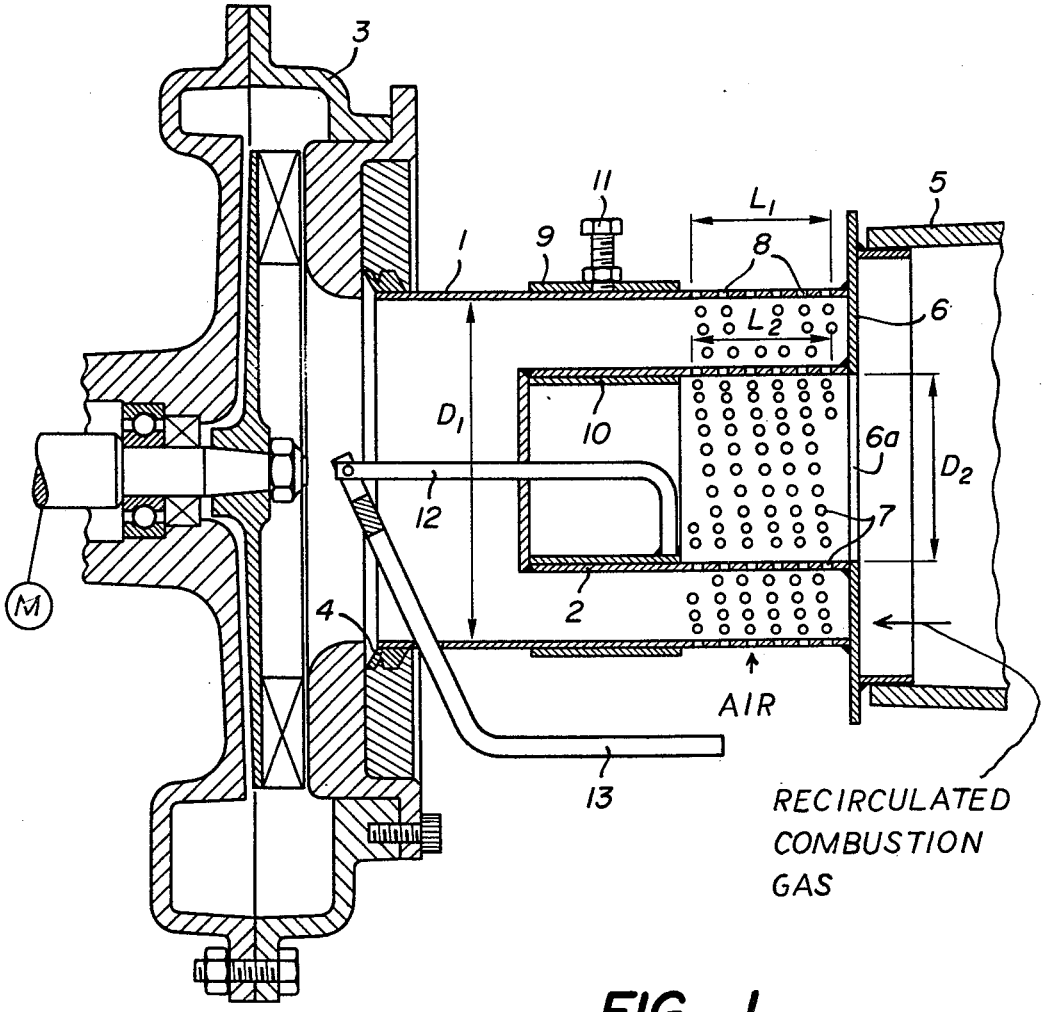
FIG. 1 is an axial cross-sectional view through a mixing device according to the present invention, adapted to feed a burner of a combustion chamber with a mixture of air and recirculated combustion gas.
Figure 2:
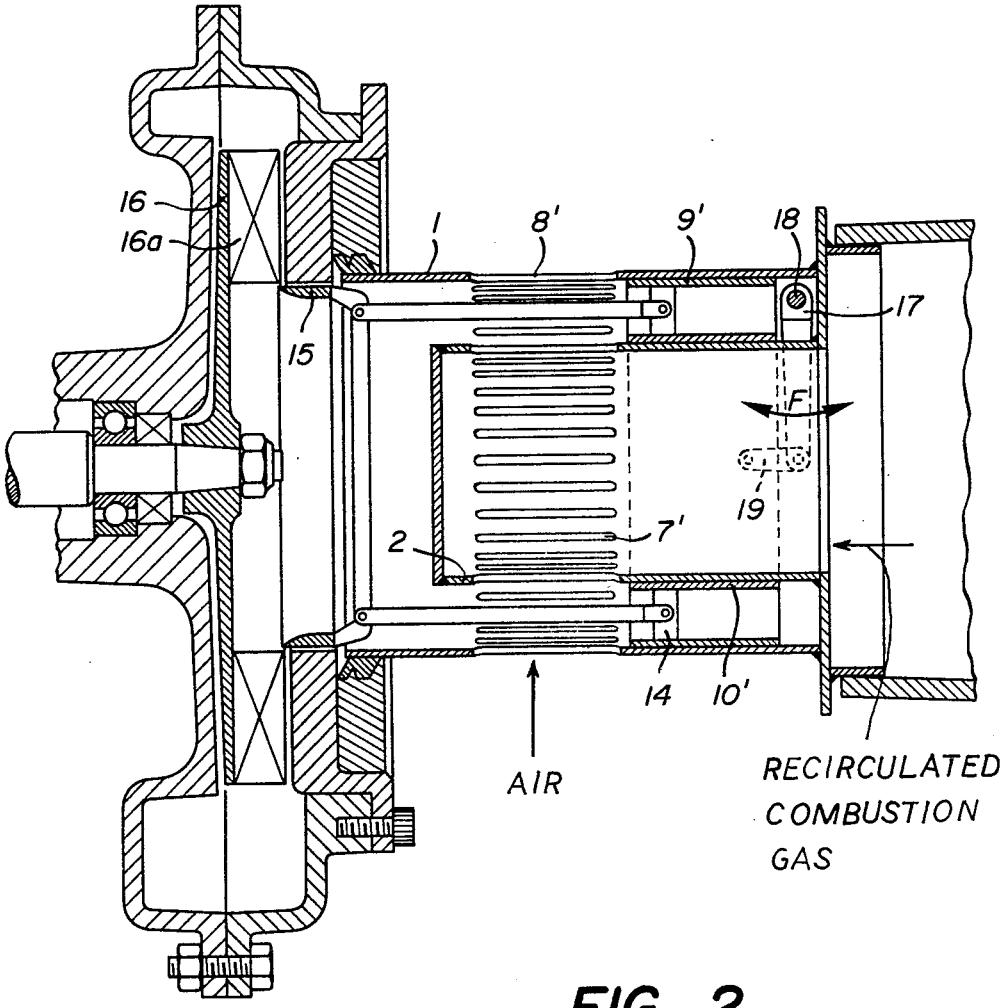
FIG. 2 is a similar view of another embodiment of the invention.

It will be understood that the device described hereinafter, either with respect to FIG. 1 or with respect to FIG. 2 is particularly suitable for use as a system for mixing air with recirculated combustion gases from a combustion chamber to produce the combustion-sustaining mixture or gas with low oxygen partial pressure which can be fed to a burner of a combustion chamber of a boiler of a thermoelectric power plant or the like as described in the aforementioned copending application.

The device shown in FIG. 1 comprises two tubular sections 1 and 2 which are disposed coaxially and concentrically in circumferentially spaced relationship. Large-diameter tube or sleeve 1 is mounted upon the scroll of a blower 3 by a flange-type coupling 4. The blower 3 feeds the burner of a power plant combustion chamber not otherwise illustrated with the mixture of air and combustion gas.

The mixing device of FIG. 1 is supplied with recirculated combustion gas which emerges from the combustion chamber of the boiler, preferably cooled gas at a temperature below 200° C., most advantageously the exhaust gases which have passed through the convection channels or between the water-carrying pipes of the boiler and are thereby cooled, having transferred the sensible heat of the gas to the water by indirect heat exchange.

This recirculated gas is passed externally of the combustion chamber, e.g. from the flue or stack of the latter. The supply duct for the recirculated combustion gas is represented at 5 and most generally will lie outside the combustion chamber, meeting the flue at the cold end of this chamber.

The inner tubular part 2 of the device is fixed to a cover plate or disk 6 which closes the end of conduit 5 but is provided with a central opening *6a* in order to communicate between the interior or inner tube 2 and the conduit 5.

At least a limited portion of the length of the tubular member 2 is formed over its cylindrical surface with a plurality of orifices 7 of equal low cross section, identical (circular) shape and uniformly distributed over this section of the tube 2.

Preferably, and for reasons which will become apparent below, the orifices 7 are disposed along a helix having a pitch corresponding to the circumferential distance separating neighboring orifices 7 along the helix, i.e. a pitch corresponding to the distance separating two neighboring orifices 7 along a generatrix of the tubular member 2.

Just as the tubular part 2 is traversed by the orifices 7, a corresponding length of the tubular part 1 is traversed by a multiplicity of orifices 8 disposed at the same density as the orifices 7 and also of identical cross section and shape, likewise located along a helix runnning in the same sense as that of the orifices 7. The orifices 7 each confront a corresponding orifice 8 along a radius through the orifices. Thus each orifice radially and directly faces an orifice of the other part.

Tests have shown that best results are obtained with orifices 7 and 8 which are of circular cross section and have a diameter of 2 - 3 mm with an opening density of the order of 35% to 65% over the surface of the parts 1 and 2 provided with the orifices. In other words, over the regions provided with the orifices, the openings constitute 35% to 65% the surface area of the tubes.

The distance separating the orifices 7 from the opposing orifices 8 has been found not to be of critical importance for effective operation of the process.

This distance can be calculated from the diameters $D_1$ and $D_2$ of the tubular parts 1 and 2 in accordance with the relationship $r = D_1 - D_2/2$, where $r$ represents the approximate spacing of each orifice 7 from the opposing orifice 8.

The diameters $D_1$ and $D_2$, however, are determined by the required opening density necessary to bring about an acceleration of the gas flows through the orifices to the order of about 50 m/sec for a given pressure drop induced by the blower.

Of course, the total open surface area is dependent upon the desired mass flow rates of the two gases. Thus primary concern is with the surface areas $S_1$ and $S_2$ of the perforated zones of parts 1 and 2, respectively.

These surfaces are defined by the relationships:

$$S_1 = \pi D_1 L_1$$

$$S_2 = \pi D_2 L_2$$

where $L_1$ and $L_2$ are the axial lengths of the perforated sections of the tubular parts 1 and 2 and generally will be equal to one another to ensure that each orifice of one part is confronted by an orifice of the other part.

When the ratio of recirculated combustion gas to the total combustion gases produced in the combustion chamber is about 50% (by volume) and the velocity of the partial streams or jets traversing the orifices 7 and 8 is about 50 m/sec, the radial distances between the orifices can range between 10 and 30 mm.

The device of the present invention also comprises a mechanism for regulating the respective fluid flows. In the embodiment of FIG. 1, this mechanism comprises two control sleeves 9 and 10 associated with part 1 and part 2, respectively, and designed to slide axially on the respective tubular parts.

The longitudinal axial length of the sleeves corresponds preferably to the axial lengths of the tubular sections traversed by the orifices 7 and 8.

Control sleeve 9 is mounted on the exterior of tubular part 1 and is provided with a locking device in the form of a screw 11 provided with a counter nut, adapted to bear against the outer surface of part 1 to fix the sleeve 9 in an axial position determined by the air flow desired.

The sleeve 10 is slidable within the tubular part 2 and is actuated from the exterior by a rod 12 which passes through the closed end of tube 2 and is rigid with the sleeve 10. The rod 12 is articulated to an actuating lever 3 which passes through an opening in tubular part 1 and can be displaced from the exterior of the device.

The device illustrated in FIG. 1 operates as follows:

When the blower 3 is set in operation, e.g. by a motor driving its shaft (not shown), it creates a reduced pressure within the device which is determined by the rate of operation and the capacity of the blower whose intake side is axially aligned with the mixing chamber. The burner of the boiler (not shown) is fed by the blower 3 and produces a mass of combustion gas which is discharged through the chimney (not shown). It suffices for an understanding of the present invention to know that the conduit or duct 5 of the mixing device and its tubular part 2 is connected to the chimney over another conduit through which the cooled combustion gas can be evacuated.

Since the tubular part 1 is disposed in direct contact with the atmosphere, which constitutes the source of air utilized as the combustion-sustaining gas, and the interior of tubular part 2 communicates with a source of recirculated combustion gas through the duct 5, the pressure drop created by the blower 3 results in an acceleration and flow of air and combustion gas through the orifices 8 and 7, respectively.

Since the total open cross section of each of tubular part 1 and tubular part 2 is such as to act as a constriction to the flow of these gases, the velocity thereof, as a result of the pressure drop across the orifices, provides a sharp acceleration of the gases so that they are directed against one another in the form of jets having velocities of the order of 50 m/sec. The jets emerging from the orifices 7 and 8 are directed against one another and meet in violent turbulence. The jets interpenetrate and are then carried axially as a mixture which has been found to be free from the nonhomogeneities characterizing earlier mixtures and mixing systems.

The efficiency of the mixing process resulting from the impact of a plurality of jets against one another has been demonstrated in practice and has been found to be especially effective in producing gas mixtures of air and recirculated combustion gases to be fed to the burner of a boiler. Thus, while it has not been possible heretofore to obtain combustion with a stable blue flame in spite of the mixing produced by a blower and the division of one of the gases into a plurality of partial streams upon introduction into the other, the process of the present invention provides a mixture capable of sustaining combustion with an intense blue flame of high stability. Tests have shown that the desired macroscopic mixing state referred to by Pratt in the article referred to above is attained and that the mixture is both homogeneous in space and in time.

Furthermore, the device illustrated in FIG. 1, because of the sleeves 9 and 10 which are adjustable, permits the pressure drop across the orifices to be adjusted to regulate the flow of the respective gases through the blower. This adjustment has been found to be highly accurate by reason of the disposition of the orifices along helices because this orientation permits axial movement of the sleeves 9 and 10 to cover the orifices 7 and 8 successively.

FIG. 2 shows a variation of the control mechanism in which the sleeves 9 and 10 are both coupled together. The sleeve 9' is here disposed within the tube 1 which is provided with elongated slot-shaped longitudinal orifices 8', while the sleeve 10 is disposed along the exterior of the tube 2 which is provided with similar slot-shaped orifices 7' each disposed radially opposite one of the orifices 8'. The sleeves 9 and 10 are rigid with one another and are connected by radial vanes 14, which may be four in number, disposed at right angles to one another.

The vanes 14 are connected to a cylindrical shield 15 mounted in the region of the intake orifice of the blower 3 coaxially with its rotor 16. The diameter of this shield 15 corresponds substantially, with tolerances to permit axial movement, to the inner diameter of the array **16*a*** of the blades of the blower.

An actuating lever system is provided by a shaft 18 pivotally mounted within the device and extending transversely to the axis thereof and two arms 17 mounted on the shaft, only one of which is visible in FIG. 2. The arms 17 are located in the annular space between the two parts 1 and 2 and are connected to the inner sleeve 10' by a link 19 pivotally joined to this inner sleeve and articulated to the arms 17. The shaft 18 can be rotated manually or automatically from the exterior of the device in order to displace the arms 17 as represented by the double-headed arrow F. The sleeves 9' and 10' can thus be axially displaced.

When the arms 17 are swung in the clockwise sense, the sleeves 9' and 10' and the shield 15 are displaced toward the left as seen in FIG. 2 to reduce the intake of the blower and simultaneously the flow cross sections of the orifices 7' and 8' so as to maintain a substantially constant flow of the characteristic flow/pressure curve. Thus it is relatively easy to vary the throughput of the gas - air mixture while maintaining the pressure drop across the orifices substantially constant.

This allows the mixer (and the blower) to be operated with varying outputs to supply the requirements of the burner. During startup of the burner, the flow is reduced and during normal operation the flow is increased. This has been found to be particularly desirable for supplying high-power boilers and, in this case, shaft 18 can be operated by a motor (not shown).

We claim:

1. A process for mixing two fluids comprising the steps of:

generating a pressure drop across a pair of surfaces each forming a wall of a mixing chamber and confronting one another while separating a respective source of fluid from the mixing chamber, the surfaces being provided with mutually aligned and opposing apertures accelerating the respective gases through said apertures in opposing jets; and conducting the resulting mixture of said fluids away from said chamber substantially parallel to said surfaces, said jets being directed against one another at velocities of the order of 50 m/sec.

2. A process for mixing two fluids comprising the steps of:

generating a pressure drop across a pair of surfaces each forming a wall of a mixing chamber and confronting one another while separating a respective source of fluid from the mixing chamber, the surfaces being provided with mutually aligned and opposing apertures accelerating the respective gases through said apertures in opposing jets;

conducting the resulting mixture of said fluids away from said chamber substantially parallel to said surfaces, one of said fluids being air and the other of said fluids being a recirculated combustion gas; and feeding the resulting mixture as a combustion-sustaining gas to a burner, burning a combustible with said combustion-sustaining gas to produce said combustion gas and recirculating the combustion gas thus produced to said mixing chamber as said other of said fluids.

3. The process defined in claim 2 wherein said pressure drop is generated by evacuating said chamber.

4. A device for mixing two fluids comprising:

means forming a mixing chamber having a pair of mutually facing spaced-apart walls;

means for supplying respective fluids to sides of said walls opposite those exposed to said chamber from said walls being formed with respective arrays of orifices, the orifices of one of said walls being directly opposite the orifices of the other of said walls;

means for evacuating said chamber to induce the flow of the respective fluids through the respective orifices at high-velocity jets trained against one another; and a respective shield displaceable along each of said walls for selectively blocking some of the orifices thereof.

5. The device defined in claim 4 wherein each of said walls is formed by a cylindrical surface of a tube, said tubes being coaxial, said shields each being sleeves slidable along the respective tubes.

6. The apparatus defined in claim 5, wherein the orifices along each of said tubes are disposed along helices.

7. The apparatus defined in claim 5 wherein said means for generating said pressure drop is an axial intake blower having its intake communicating with the interior of the outermost of said tubes.

8. The apparatus defined in claim 7 further comprising means for connecting said shields for simultaneous joint movement.

9. The apparatus defined in claim 7, further comprising another shield shiftable axially relative to said blower for blocking the intake flow cross section thereof, said shields being connected together for joint movement.

10. The apparatus defined in claim 6 wherein said blower communicates with the burner of a combustion chamber, further comprising a duct forming one of said sources and communicating with said chamber for circulating combustion gas therefrom to said mixing chamber.

* * * * *